US006354452B1

(12) United States Patent
DeSalvo et al.

(10) Patent No.: US 6,354,452 B1
(45) Date of Patent: Mar. 12, 2002

(54) COLLECTION CONTAINER ASSEMBLY

(75) Inventors: Danielle DeSalvo, Butler, NJ (US); C. Mark Newby, Tuxedo; Timothy A. Stevens, Warwick, both of NY (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/625,287

(22) Filed: Jul. 25, 2000

(51) Int. Cl.[7] ..... B65D 25/00

(52) U.S. Cl. ..... 220/23.87; 215/247; 215/12.1; 215/13.1; 220/592.2

(58) Field of Search ..... 220/23.87, 592.27, 220/592.26, 592.2; 215/247, 12.1, 13.1

(56) References Cited

U.S. PATENT DOCUMENTS 3,225,954 A * 12/1965 Herrick et al. ..... 220/892.2
3,578,197 A * 5/1971 Taylor ..... 220/892.23
4,473,161 A * 9/1984 Zimmerman ..... 220/892.27
4,865,014 A * 9/1989 Nelson ..... 220/892.27
4,967,919 A * 11/1990 Earhart ..... 215/247
5,232,111 A * 8/1993 Burns ..... 215/247
5,377,854 A * 1/1995 Cusack ..... 215/364
5,699,923 A * 12/1997 Burns ..... 215/247
5,738,233 A * 4/1998 Burns ..... 215/247

* cited by examiner

*Primary Examiner*—Joseph M. Moy
(74) *Attorney, Agent, or Firm*—Nanette S. Thomas

(57) ABSTRACT

The present invention is a container assembly that includes an inner tube formed from a plastic that is substantially inert to bodily fluids and an outer tube that is formed from a different plastic. Collectively, the container assembly is useful for providing an effective barrier against gas and water permeability in the assembly and for extending the shelf-life of the container assembly, especially when used for blood collection.

16 Claims, 3 Drawing Sheets

COLLECTION CONTAINER ASSEMBLY

BACKGROUND OF THE INVENTION

1. Field of the Invention

The invention relates to a collection container assembly that includes a plurality of nested containers formed from different respective materials and provides an effective is barrier against water and gas permeability and for extending the shelf-life of assembly especially when used for blood collection.

2. Description of Related Art

Plastic tubes contain an inherent permeability to water transport due to the physical properties of the plastic materials used in manufacturing tubes. Therefore, it is difficult to maintain the shelf-life of plastic tubes that contain a liquid additive. It is also appreciated that deterioration of the volume and concentration of the liquid additive may interfere with the intended use of the tube.

In addition, plastic tubes that are used for blood collection require certain performance standards to be acceptable for use in medical applications. Such performance standards include the ability to maintain greater than about 90% original draw volume over a one-year period, to be radiation sterilizable and to be non-interfering in tests and analysis.

Therefore, a need exists to improve the barrier properties of articles made of polymers and in particular plastic blood collection tubes wherein certain performance standards would be met and the article would be effective and usable in medical applications. In addition, a need exists to preserve the shelf-life of containers that contain liquid additives. The time period for maintaining the shelf-life is from manufacturing, through transport and until the container is actually used.

SUMMARY OF THE INVENTION

The present invention is a container assembly comprising inner and outer containers that are nested with one another. The inner and outer containers both are formed from plastic materials, but preferably are formed from different plastic materials. Neither plastic material is required to meet all of the sealing requirements for the container. However, the respective plastic materials cooperate to ensure that the assembly achieves the necessary sealing, adequate shelf life and acceptable clinical performance. One of the nested containers may be formed from a material that exhibits acceptable vapor barrier characteristics, and the other of the containers may be formed from a material that provides a moisture barrier. The inner container also must be formed from a material that has a proper clinical surface for the material being stored in the container assembly. Preferably, the inner container is formed from polypropylene (PP), and the outer container is formed from polyethylene terephthalate (PET).

The inner and outer containers of the container assembly preferably are tubes, each of which has a closed bottom wall and an open top. The outer tube has a substantially cylindrical side wall with a selected inside diameter and a substantially spherically generated bottom wall. The inner tube has an axial length that is less than the outer tube. As a result, a closure can be inserted into the tops of the container assembly for secure sealing engagement with portions of both the inner and outer tubes. The bottom wall of the inner tube is dimensioned and configured to nest with or abut the bottom wall of the outer tube. Additionally, portions of the inner tube near the open top are configured to nest closely with the outer tube. However, portions of the inner tube between the closed bottom and the open top are dimensioned to provide a continuous circumferential clearance between the tubes. The close nesting of the inner tube with the outer tube adjacent the open top may be achieved by an outward flare of the inner tube adjacent the open top. The flare may include a cylindrically generated outer surface with an outside diameter approximately equal to the inside diameter of the side wall of the outer tube. The flare further includes a generally conically tapered inner surface configured for tight sealing engagement with a rubber closure.

The container assembly of the present invention achieves the required shelf life for medical applications. Furthermore, the inner container can be formed from a material that will exhibit appropriate clinical performance in the presence of the specimen and/or additives in the container assembly.

The container of the present invention substantially eliminates the complications of maintaining the shelf-life of plastic containers that contain liquid additives. In addition, the container of the present invention minimizes the rate of moisture loss from plastic containers that contain liquid additives.

The container of the present invention provides the means to deliver a higher quality plastic container product to the customer because liquid additive concentration, additive volume and additive solubility are better controlled.

Another notable attribute of the container of the present invention is that it will not interfere with testing and analysis that is typically performed on blood in a tube. Such tests include but are not limited to, routine chemical analysis, biological inertness, hematology, blood chemistry, blood typing, toxicology analysis or therapeutic drug monitoring and other clinical tests involving body fluids. Further, the container of the present invention may be subjected to automated machinery such as centrifuges and may be exposed to certain levels of radiation in the sterilization process with substantially no change in optical, mechanical or functional properties.

Most notably, is that the container of the present invention impedes the rate of water vapor transport from within the container interior and thus controls additive solution concentration and volume for containers containing a liquid additive.

DETAILED DESCRIPTION

Figure 1:
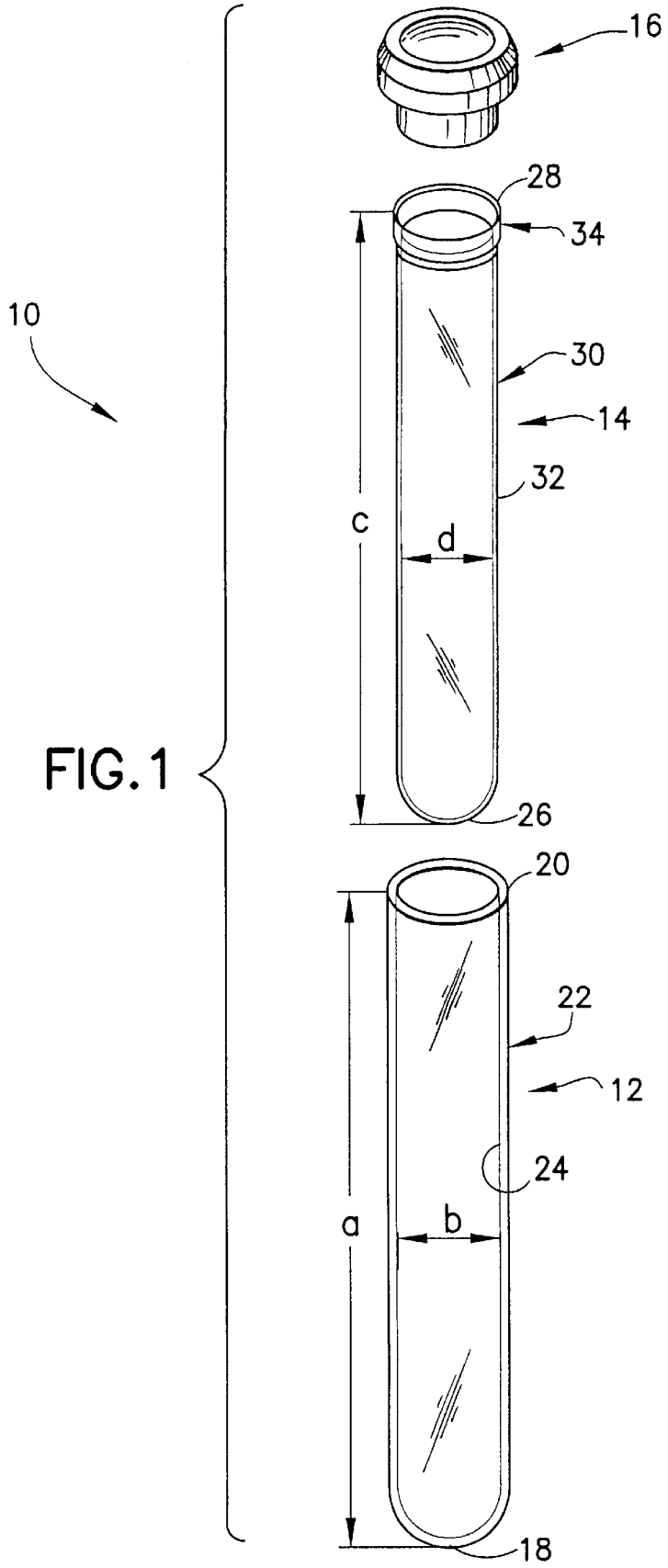
FIG. 1 is an exploded perspective view of the container assembly of the present invention.
Figure 2:
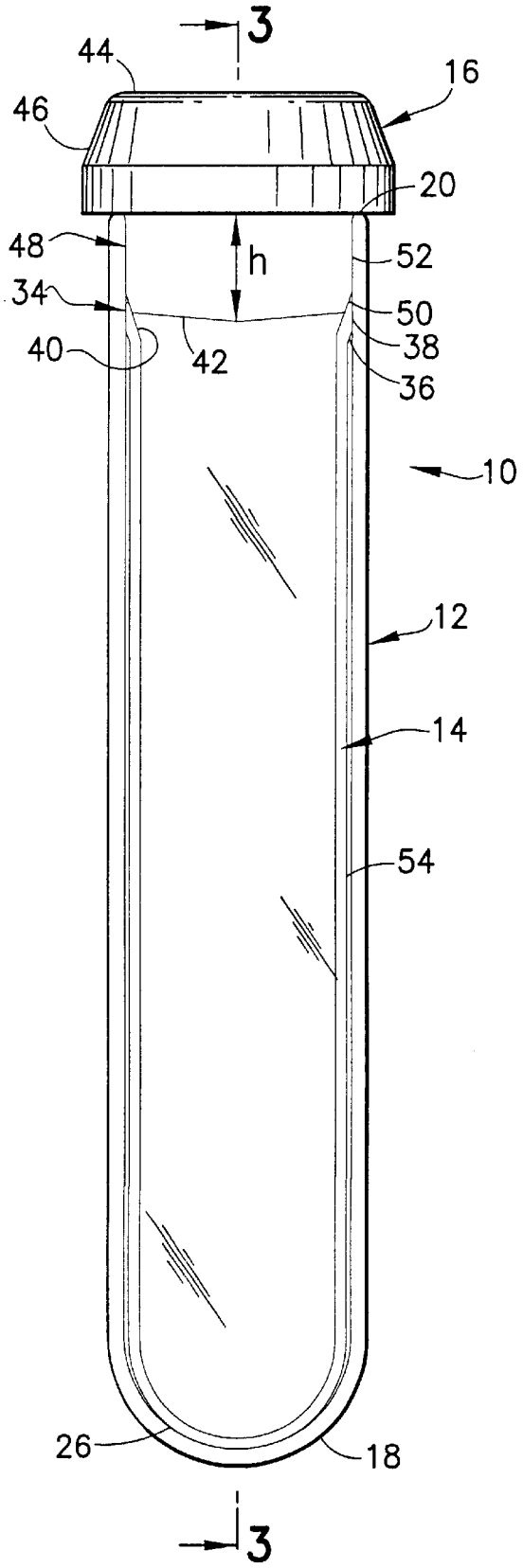
FIG. 2 is a side elevational view of the container assembly of FIG. 1 in its assembled condition.
Figure 3:
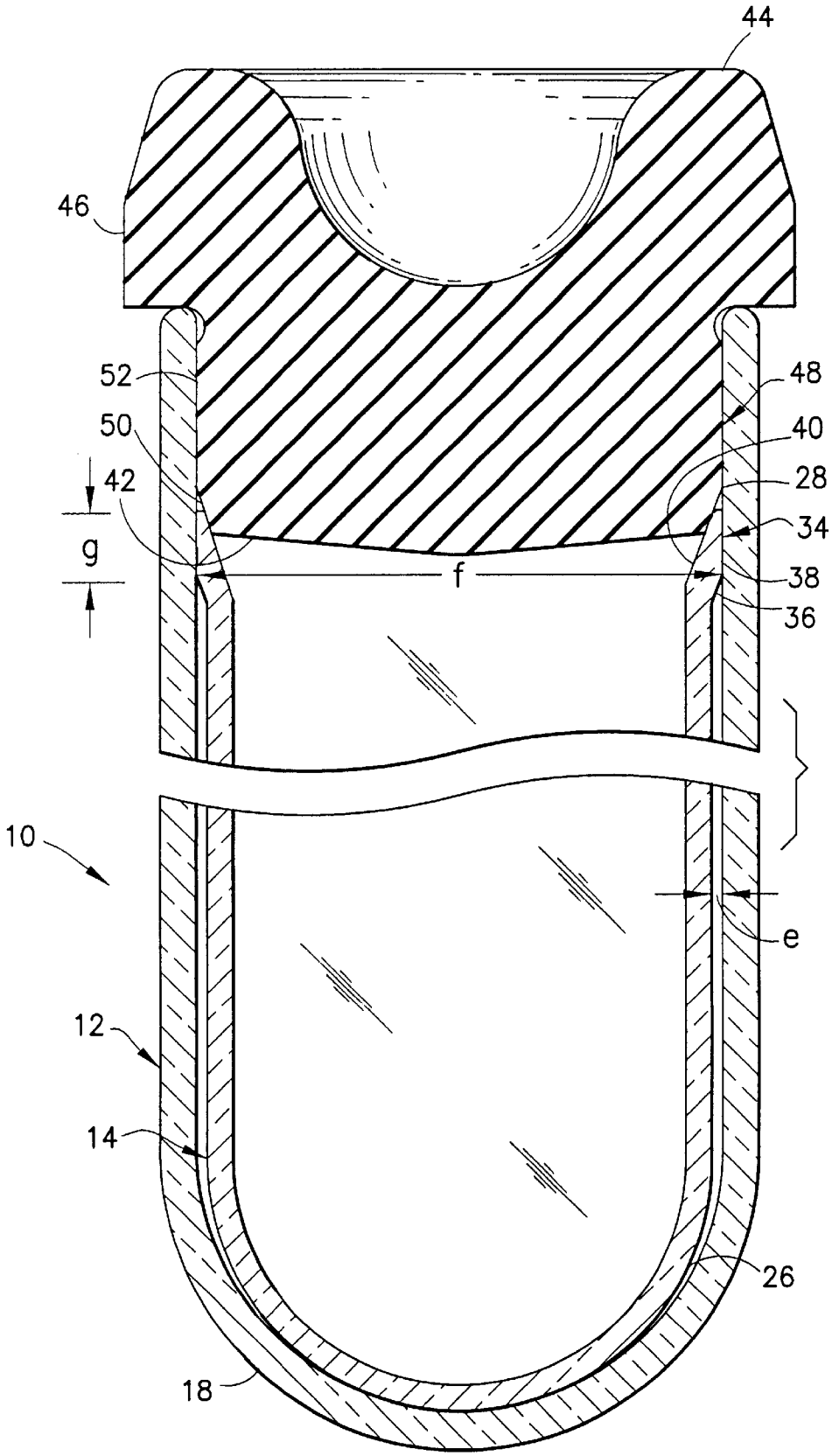
FIG. 3 is a cross-sectional view taken along line 3—3 of FIG. 2.

As shown in FIGS. 1–3, an assembly 10 includes an outer tube 12, an inner tube 14 and a closure 16.

Outer tube 12 is unitarily formed from PET and includes a spherically generated closed bottom wall 18, an open top 20 and a cylindrical wall 22 extending therebetween whereby side wall 22 slightly tapers from open top 20 to closed bottom wall 18. Outer tube 12 defines a length "a" from the interior of the bottom wall 18 to the open top 20. Side wall 22 of outer tube 12 includes a cylindrically generated inner surface 24 with an inside diameter "b".

Inner tube 14 is unitarily formed from polypropylene and includes a spherically generated closed bottom wall 26, an open top 28 and a cylindrical side wall 30 extending therebetween whereby side wall 30 slightly tapers from open top 28 to closed bottom wall 26. Inner tube 14 defines an external length "c" that is less than internal length "a" of outer tube 12. Side wall 30 of outer tube 14 includes a cylindrical section 32 extending from bottom wall 26 most of the distance to open top 28 of inner tube 14. However, side wall 30 is characterized by a circumferentially enlarged section 34 adjacent open top 28. Enlarged top section 34 of side wall 30 includes an outwardly flared outer surface 36 adjacent cylindrical portions 32 of side wall 30 and a cylindrical outer surface 38 adjacent open top 28 of inner tube 14. Additionally, enlarged top section 34 of side wall 30 includes a conically flared inner surface 40 adjacent open top 28.

Cylindrical portion 32 of side wall 30 of inner tube 14 has a diameter "d" that is less than inside diameter "b" of side wall 22 on outer tube 12. In particular, outside diameter "d" of cylindrical portion 32 of side wall 30 is approximately 0.12" less than inside diameter "b" of side wall 22 on outer tube 12. As a result, an annular clearance "e" of approximately 0.006" will exist between cylindrical portion 32 of side wall 30 of inner tube 14 and side wall 22 of outer tube 12 as shown most clearly in FIG. 3.

Cylindrical outer surface 38 of enlarged top section 34 on side wall 30 defines an outside diameter "f" which is approximately equal to inside diameter "b" of side wall 22 of outer tube 12. Hence, cylindrical outer surface 38 of enlarged section top 34 will telescope tightly against cylindrical inner surface 24 of side wall 22 of outer tube 12 as shown in FIG. 3. Enlarged top section 34 of inner tube 12 preferably defines a length "g" that is sufficient to provide a stable gripping between outer tube 12 and inner tube 14 at enlarged top section 34. In particular, a length "g" of about 0.103" has been found to provide acceptable stability.

Closure 16 preferably is formed from rubber and includes a bottom end 42 and a top end 44. Closure 16 includes an external section 46 extending downwardly from top end 44. External section 46 is cross-sectionally larger than outer tube 12, and hence will sealingly engage against open top end 20 of outer tube 12. Closure 16 further includes an internal section 48 extending upwardly from bottom end 42. Internal section 48 includes a conically tapered lower portion 50 and a cylindrical section 52 adjacent tapered section 50. Internal section 48 defines an axial length "h" that exceeds the difference between internal length "a" of outer tube 12 and external length "c" of inner tube 14. Hence, internal section 48 of closure 16 will engage portions of outer tube 12 and inner tube 14 adjacent the respective open tops 20 and 28 thereof, as explained further below. Internal section 52 of closure 16 is cross-sectionally dimensioned to ensure secure sealing adjacent open tops 22 and 28 respectively of outer tube 12 and inner tube 14.

Assembly 10 is assembled by slidably inserting inner tube 14 into open top 20 of outer tube 12. The relatively small outside diameter "d" of cylindrical portion 32 of side wall 30 permits insertion of inner tube 14 into outer tube 12 without significant air resistance. Specifically, air in outer tube 12 will escape through the circumferential space between cylindrical portion 32 of side wall 30 of inner tube 14 and cylindrical inner surface 24 of outer tube 12. This relatively easy insertion of inner tube 14 into outer tube 12 is achieved without an axial groove in either of the tubes. The escape of air is impeded when enlarged top section 34 of inner tube 14 engages side wall 22 of outer tube 12. However, insertion of inner tube 14 into outer tube 12 is nearly complete at that stage of insertion, and hence only a minor compression of air is required to complete insertion of inner tube 14 into outer tube 12. Insertion of inner tube 14 into outer tube 12 continues until the outer surface of spherically generated bottom wall 26 of inner tube 12 abuts the inner surface of bottom wall 18 on outer tube 12 in an internally tangent relationship. In this condition, as shown most clearly in FIGS. 2 and 3, inner tube 14 is supported by the internally tangent abutting relationship of bottom wall 26 of inner tube 14 with bottom wall 18 of outer tube 12. Additionally, inner tube 14 is further supported by the circumferential engagement of outer circumferential surface 38 of enlarged top section 34 with inner circumferential surface 24 of side wall 22 on outer tube 12. Hence, inner tube 14 is stably maintained within outer tube 12 with little or no internal movement that could be perceived as a sloppy fit. This secure mounting of inner tube 14 within outer tube 12 is achieved without a requirement for close dimensional tolerances along most of the length of the respective inner and outer tubes 14 and 12 respectively.

A substantially cylindrical space 54 is defined between inner tube 14 and outer tube 12 along most of their respective lengths. However, space 54 is sealed by outer cylindrical surface 38 of enlarged top section 34. Consequently, there is no capillary action that could draw liquid, such as citrate, into cylindrical space 54, and accordingly there is no perception of contamination.

The assembly of inner tube 14 with outer tube 12 can be sealed by stopper 16. In particular, tapered portion 50 of internal section 48 facilitates initial insertion of stopper 16 into open top 20 of outer tube 12. Sufficient axial advancement of stopper 16 into open top 20 will cause cylindrical outer surface 52 of internal section 48 to sealingly engage internal surface 24 of outer tube 12. Further insertion will cause tapered surface 50 of internal section 48 to sealingly engage tapered internal surface 40 of enlarged section 34 of inner tube 14. Hence, closure 16 securely seals internal top regions of both inner tube 14 and outer tube 12. Furthermore, engagement between closure 16 and tapered internal surface 40 of enlarged section 34 contributes to the sealing engagement between cylindrical external surface 38 of enlarged section 34 and cylindrical internal surface 24 of outer tube 14.

While the invention has been defined with respect to a preferred embodiment, it is apparent that changes can be made without departing from the scope of the invention as defined by the appended claims.

What is claimed is:

1. A container assembly comprising an outer container formed from a first plastic material and having a closed bottom wall, an open top and a side wall extending therebetween, an inner container formed from a second plastic material and having a closed bottom wall, an open top and a side wall extending therebetween, the inner container being disposed within the outer container such that the bottom wall of the inner container abuts the bottom wall of the outer container and such that portions of the inner container adjacent the open top engage the side wall of the outer container, portions of the inner container between the bottom wall and the open top being spaced inwardly from the side wall of the outer container, whereby spacing between the inner and outer containers facilitates insertion of the inner container into the outer container and whereby the abutment of the respective bottom walls and the engagement of the side walls adjacent the open top of the inner container provides secure substantially immovable positioning of the inner container within the outer container.

2. The container assembly of claim 1, wherein the outer container is formed from a plastic material that is a vapor barrier, and wherein the inner container is formed from a plastic material that is a moisture barrier.

3. The container assembly of claim 1, wherein the inner container is formed from polypropylene.

4. The container assembly of claim 3, wherein the outer container is formed from PET.

5. The container assembly of claim 1, wherein the side wall of the inner container is flared outwardly adjacent the open top of the inner container for sealing and supporting engagement with the side wall of the outer container.

6. The container assembly of claim 1, wherein the side wall of the inner container is shorter than the side wall of the outer container, such that the open top of the inner container is spaced inwardly from the open top of the outer container.

7. The container assembly of claim 6, further comprising a closure sealingly engaged with portions of the inner and outer containers adjacent the open tops thereof.

8. The container assembly of claim 1, wherein the first and second containers are substantially cylindrical tubes.

9. A container assembly comprising:

an outer tube unitarily formed from PET, the outer tube having a substantially spherically generated closed bottom wall, an open top and a cylindrical side wall extending therebetween; and an inner tube unitarily formed from polypropylene and having a substantially spherically generated closed bottom wall, an open top and a side wall extending therebetween, said inner tube being disposed within said outer tube such that said bottom wall of said inner tube abuts said bottom wall of said outer tube, said side wall of said inner tube having an enlarged top section adjacent said open top, said enlarged top section including a cylindrically generated outer surface disposed in secure sealing and supporting engagement with said side wall of said outer tube, portions of said side wall of said inner tube between said enlarged top section and said bottom wall of said inner tube being spaced inwardly from said side wall of said outer tube to define a cylindrical space therebetween.

10. The container assembly of claim 9, wherein the open top of the inner tube is between the open top of the outer tube and the bottom wall of the outer tube, and is spaced from the open top of the outer tube by a selected distance.

11. The container assembly of claim 9, wherein the cylindrical space between the inner and outer tubes defines a radial thickness of approximately 0.006".

12. The container assembly of claim 9, wherein the cylindrical outer surface of the enlarged top section of the inner tube defines an axial length of about 0.103".

13. The container assembly of claim 9, wherein the enlarged section of the inner tube includes a conically flared inner surface.

14. The container assembly of claim 9, further comprising a closure for closing the respective open top ends of the inner and outer tubes.

15. The container assembly of claim 14, wherein the closure is formed from rubber.

16. The container assembly of claim 15, wherein the closure is dimensioned for sealingly engaging portions of the side wall of the outer tube adjacent the open top thereof and portions of the side wall of the inner tube adjacent the open top thereof.

* * * * *